United States Patent [19]

Sluijter et al.

[11] Patent Number: 4,625,327

[45] Date of Patent: Nov. 25, 1986

[54] SPEECH ANALYSIS SYSTEM

[75] Inventors: Robert J. Sluijter; Hendrik J. Kotmans, both of Eindhoven, Netherlands

[73] Assignee: U.S. Philips Corporation, New York, N.Y.

[21] Appl. No.: 487,390

[22] Filed: Apr. 21, 1983

[30] Foreign Application Priority Data

Apr. 27, 1982 [EP] European Pat. Off. ..... 82200500.5

[51] Int. Cl.[4] ..... G10L 5/00

[52] U.S. Cl. ..... 381/49

[58] Field of Search ..... 381/36–50; 364/513.5

[56] References Cited

U.S. PATENT DOCUMENTS 4,015,088 3/1977 Dubnowski et al. ..... 381/49
4,331,837 5/1982 Soumagne ..... 381/46
4,351,983 9/1982 Crouse et al. ..... 381/46
4,359,604 11/1982 Du Mont ..... 381/46
4,441,200 4/1984 Fette et al. ..... 381/36

OTHER PUBLICATIONS

Rabiner, et al., "A Comparative Performance Study of Several Algorithms", IEEE Trans. on Acoustics, S and SP, Oct. 1976, pp. 399–418.

*Primary Examiner*—E. S. Matt Kemeny
*Attorney, Agent, or Firm*—Robert T. Mayer; Bernard Franzblau

[57] ABSTRACT

Speech analysis system in which segments of speech are analyzed. For the voiced/unvoiced decision use is made of the average magnitude or waveform intensity of successive speech segments. Basically a voiced decision is made when the waveform intensity increases monotonically over several segments by more than a given factor. An unvoiced decision is made if the waveform intensity drops below a given fraction of the maximum waveform intensity in the current voiced period. Refinements in the decisions are made by the use of fixed and adaptive thresholds.

2 Claims, 3 Drawing Figures

SPEECH ANALYSIS SYSTEM

BACKGROUND OF THE INVENTION (1) Field of the Invention

The invention relates to a speech analysis system comprising means for receiving an input analog speech signal and means for determining at regularly recurring instants the mean value of the rectified speech signal in segments thereof preceding said instants, the mean values thus determined providing a measure for separating voiced speech segments from unvoiced speech segments.

(2) Description of the Prior Art

Such a speech analysis system is generally known in the art of vocoders. As an example reference may be made to Proceedings of the IEEE, Vol. 63, No. 4, April 1975, pp 662–677. It is mentioned therein, that an energy function of the speech signal, such as the afore mentioned mean value, which is also termed waveform intensity or average magnitude, is a good measure for separating voiced segments from unvoiced segments. However, it is found in practice that the voiced-unvoiced decision based hereon is unreliable for a range of values of the waveform intensity.

It has also been mentioned, that basically, a pitch detector is a device, which makes a voiced-unvoiced (V/U) decision, and, during periods of voiced speech, provides a measurement of the pitch period. However, some pitch detection algorithms just determine the pitch during voiced segments of speech and rely on some other technique for the voiced-unvoiced decision. Cf. IEEE Transactions on Acoustics, Speech and Signal Processing, Vol. ASSP-24, No. 5, October 1976, pp 399–418.

Several voiced-unvoiced detection algorithms are described in said last publication, based on the autocorrelation function, a zero-crossing count, a pattern recognition technique using a training set, or based on the degree of agreement among several pitch detectors. These detection algorithms use as input the time domain or frequency domain data of the speech signal in practically the whole speech band, while for pitch detection on the contrary the data of a low pass filtered speech signal are generally used.

SUMMARY OF THE INVENTION

It is an object of the invention to provide in the aforementioned speech analysis system a more reliable method or voiced-unvoiced detection based on the average magnitude that uses as an input the same data that are generally used as an input for pitch detection i.e. the data of a low pass filtered speech signal, in particular in the frequency range between about 200–800 Hz.

In the speech analysis system in accordance with the invention provision is made of a bistable indicator settable to indicate a period of voiced speech and resettable to indicate a period of unvoiced speech or the absence of speech, and programmable computing means programmed to carry out the proces including the steps of:

determining for each segment (number I) the mean value (M(I)) of the rectified speech signal of the relevant segment in a low frequency band of about 200–800 Hz, determining, if said indicator is set, for each segment and a number of preceding segments the maximum value (VM(I)) of the mean values M(n), with n=I, I−1, . . . I+1−m, in which m is such that between segments I and I+1−m there is no change in the state of the indicator, determining for each segment an adaptive threshold (AT(I)) by setting AT(I) equal to a fraction of the maximum value VM(I) if said indicator is set and by setting AT(I) equal to a fraction of AT(I−1) if said indicator is reset, setting the bistable indicator if the mean values M(n) with n=I, I−1, . . . I+1−k, wherein k is a predetermined number, increase monotonically for increasing values of n, by more than a given factor and M(I) exceeds the adaptive threshold AT(I−1), resetting the bistable indicator if the mean value M(I) is smaller than a given fraction cf the maximum value VM(I−1) or is smaller than a predetermined threshold.

In accordance with this method the unvoiced-to-voiced decision is made if subsequent mean values, also termed waveform intensities, including the most recent one, increase monotonically by more than a given factor, which in practice may be the factor three, and if in addition, the most recent waveform intensity exceeds a certain adaptive threshold. In speech, the onset of a voiced sound is nearly always attended with the mentioned intensity increase. However unvoiced plosives sometimes show strong intensity increases as well, in spite of the bandwidth limitation.

Indeed some unvoiced plosives are effectively excluded because almost all their energy is located above 800 Hz, but others show significant intensity increases in the 200–800 Hz band. The adaptive threshold makes a distinction between intensity increases due to unvoiced plosives and voiced onsets. It is initially made proportional to the maximum waveform intensity of the previous voiced sound, thus following the coarse speech level. In unvoiced sounds, the adaptive threshold decays with a large time constant. This time constant should be such, that the adaptive threshold is nearly constant between two voiced sounds in fluent speech to prevent intermediate unvoiced plosives being detected as voiced sounds. But after a distinct speech pause the adaptive threshold must have decayed sufficiently to enable the detection of subsequent low level voiced sounds. Too large a threshold would incorrectly reject voiced onsets in this case. A time constant of typically a few seconds appears to be a suitable value.

The voiced-to-unvoiced transition is ruled by a threshold, the magnitude of which amounts to a certain fraction of the maximum intensity in the current voiced speech sound. As soon as the waveform intensity becomes smaller than this threshold it is decided for a voiced-to-unvoiced transition.

A large fixed threshold is used as a safeguard. If the waveform intensity exceeds this threshold the segment is directly classified as voiced. The value of this threshold is related to the maximum possible waveform intensity and may in practice amount to 10% thereof.

Additionally, a low-level predetermined threshold is used. Segments of which the waveform intensities do not exceed this threshold are directly classified as unvoiced. The value of this threshold is related to the maximum possible waveform intensity and may in practice amount to 0.4% thereof.

The time lag between successive segments in different types of vocoders is usually between 10 ms and 30 ms. The minimum time interval to be observed in the voiced-unvoiced detector for a reliable decision should amount to 40–50 ms. Since the minimum time lag is assumed to be 10 ms observation of six (k=6) subsequent segments is sufficient to cover all practical cases.

Figure 1:
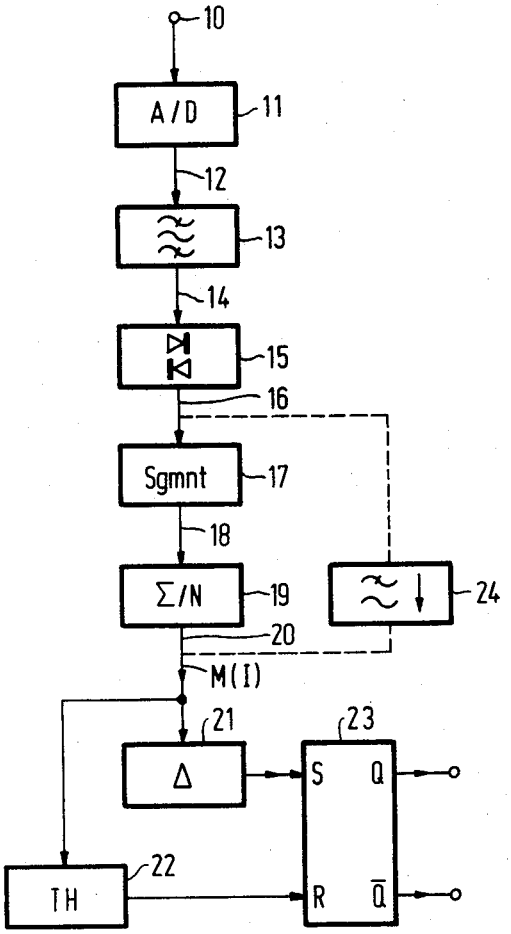
FIG. 1 is a flow diagram illustrating the succession of operations in the speech analysis system according to the invention.

In the system shown in FIG. 1 a speech signal in analog form is applied at 10 as an input to an analog-to-digital conversion operation, represented by block 11, having a sampling rate of 8 kHz and an accuracy of 12 bits per sample. The digital samples appearing at 12 are applied to a digital filtering operation in the frequency band of about 200–800 Hz, as represented by block 13. In the next operation (block 15) the absolute values of the filtered samples appearing at 14 are determined.

The absolute values appearing at 16 are next stored for 32 ms by a segment buffering operation represented by block 17. A stored segment comprises the absolute values of 256 speech samples.

In the embodiment complete segments of 256 absolute values appear at 18 with intervals of 10 ms. During each period of 10 ms the absolute values of 80 new samples are stored by the operation of block 17 and the 80 oldest absolute values are discarded. The intervals may have an other value than 10 ms and may be adapted to the value, generally between 10 ms and 30 ms, as used in the relevant vocoder. The absolute values of the samples appearing at 18 subsequently undergo an averaging operation, as represented by block 19 for determining the mean value of the absolute values in each segment. The mean value for the segment having the number I is indicated by M(I) and is also termed the waveform intensity or the average magnitude of the speech segment in the relevant frequency range of about 200–800 Hz.

The waveform intensities M(I) appearing at 20 with 10 ms intervals are subsequently processed in the blocks 21 and 22.

In the block 21 it is determined whether the waveform intensities of a series of segments including the last one is monotonically increasing by more than a given factor. In the embodiment six segments are considered and the factor is three. Also it is determined whether the waveform intensity exceeds an adaptive threshold. This adaptive threshold is a given fraction of the maximum waveform intensity in the preceding voiced period or is a value decreasing with time in an unvoiced period. A large fixed threshold is used as a safeguard. If the waveform intensity exceeds this value the segment is directly classified as voiced.

If the conditions of block 21 are fulfilled a bistable indicator 23 is set to indicate at the true output Q a period of voiced speech.

In block 22 is it determined whether the waveform intensity falls below a threshold which is a given fraction of the maximum waveform intensity in the current voiced period or falls below a small fixed threshold. If these conditions are fulfilled the bistable indicator 23 is reset to indicate at the not-true output $\overline{Q}$ a period of unvoiced speech.

An an alternative to the operations of the blocks 17 and 19 a filtering operation may be performed on the absolute values appearing at 16 combined with a sample rate reduction operation in the range of about 0–50 Hz, as represented by block 24. Suitably the sampling rate is reduced to 100 Hz. The output of operation 24 are the numbers M(I) as before appearing with intervals of 10 ms.

Figure 2:
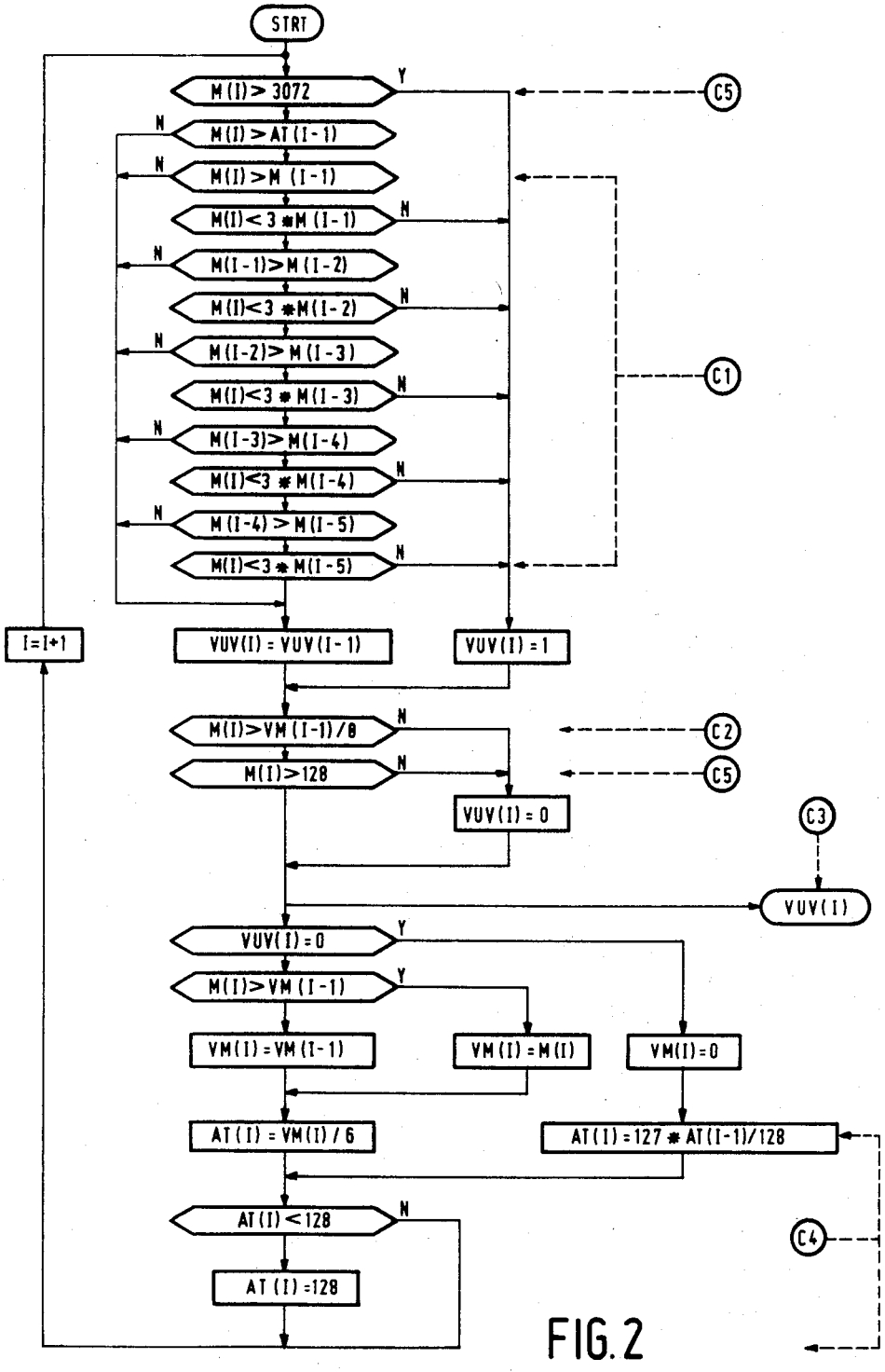
FIG. 2 is a flow diagram of a computer program which is used for carrying out certain operations in the process according to FIG. 1.

Certain operations in the process according to FIG. 1 may be fulfilled by suitable programming of a general purpose digital computer. Such may be the case for the operations performed by the blocks 21 and 22 in FIG. 1. A flow diagram of a computer program for performing the operations of the blocks 21 and 22 is shown in FIG. 2. The input to this program is formed by the numbers M(I) representing the waveform intensities of the successive speech segments.

In this diagram I stands for the segment number, AT for the adaptive threshold, VM for the maximum intensity of consecutive voiced segments, VUV is the output parameter; VUV=1 for voiced speech and VUV=0 for unvoiced speech. This parameter corresponds to the state of the bistable indicator 23 previously discussed with respect to FIG. 1.

The flow diagram is readily understandable by a man skilled in the art without further description. The following comments (C1–C5 in the figure) are presented:

Comment C1: determining whether the waveform intensity M increased monotonically over the segments I, I−1, . . . I−5 by more than a factor three, Comment C2: resetting the bistable indicator (VUV=0) if M(I) is smaller than a given fraction ($\frac{1}{3}$) of the previously established maximum intensity VM(I−1), Comment C3: output of VUV(I), corresponding to the state of the aforesaid bistable indicator 23, Comment C4: determining the adaptive threshold AT, Comment C5: the large fixed threshold is fixed at the value of 3072; the small fixed threshold is fixed at the value of 128.

Figure 3:
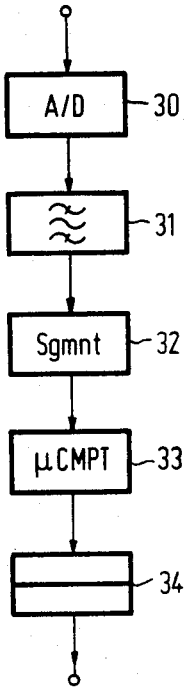
FIG. 3 is a schematic block diagram of electronic apparatus for implementing the speech analysis system according to the invention.

The speech analysis system according to the invention may be implemented in hardware by the hardware configuration which is illustrated in FIG. 3. This configuration comprises:

an A/D converter 30 (corresponding to block 11 in FIG. 1)

a digital filter 31 (block 13, FIG. 1)

a segment buffer 32 (block 17, FIG. 1)

a micro-computer 33 (blocks 19, 21 and 22 FIG. 1)

a bistable indicator 34 (block 23, FIG. 1)

The function of block 19 i.e. determining the mean value of a series of absolute values can be performed by a suitable programming of the computer 33. A flow diagram of a suitable program can be readily devised by a man skilled in the art. The function of block 15 may be performed at the input of segment buffer 32 by discarding the sign bit there, when using sign/magnitude notation, or may be performed at a later stage in the process by a suitable programming of the computer 33.

What is claimed is:

1. In a speech analysis system comprising means for receiving an input analog speech signal and means for determining at regularly recurring instants the mean value of the rectified speech signal in segments thereof preceeding said instants, the mean values thus determined providing a measure for separating voiced speech segments from unvoiced speech segments, the provision of a bistable indicator settable to indicate a period of voiced speech and resettable to indicate a period of unvoiced speech or the absence of speech, and programmable computing means programmed to carry out the process including the steps of:

determining for each segment (number I) the mean value (M(I)) of the rectified speech signal of the relevant segment in a low frequency band of about 200–800 hz, determining, if said indicator is set, for each segment and a number of preceding segments the maximum value (VM(I)) of the mean values M(n), with $n=I, I-1, \ldots I+1-m$, in which m is such that between segments I and $I+1-m$ there is no change in the state of the indicator, determining for each segment an adaptive threshold (AT(I)) by setting AT(I) equal to a fraction of the maximum value VM(I) if said indicator is set and by setting AT(I) equal to a fraction of $AT(I-1)$ if said indicator is reset, setting the bistable indicator if the mean values M(n) with $n=I, I-1, \ldots I+1-k$, wherein k is a predetermined number, increase monotonically for increasing values of n, by more than a given factor and M(I) exceeds the adaptive threshold $AT(I-1)$, resetting the bistable indicator if the mean value M(I) is smaller than a given fraction of the maximum value $VM(I-1)$ or is smaller than a predetermined threshold.

2. The process according to claim 1 characterized in that it comprises the steps of:

setting the bistable indicator if the mean value M(I) exceeds a relatively high fixed threshold, resetting the bistable indicator if the mean value M(I) does not exceed a relatively low fixed threshold.

* * * * *